US007266907B2

(12) United States Patent
Dushey

(10) Patent No.: US 7,266,907 B2
(45) Date of Patent: Sep. 11, 2007

(54) REVERSIBLE SHOE UPPER

(76) Inventor: Selim Dushey, 1794 E. 5th St., Brooklyn, NY (US) 11223

( * ) Notice: Subject to any disclaimer, the term of this patent is extended or adjusted under 35 U.S.C. 154(b) by 64 days.

(21) Appl. No.: 11/116,641

(22) Filed: Apr. 28, 2005

(65) Prior Publication Data

US 2006/0242861 A1 Nov. 2, 2006

(51) Int. Cl.
*A43B 3/24* (2006.01)
*A43B 3/12* (2006.01)

(52) U.S. Cl. ..... 36/11.5; 36/101

(58) Field of Classification Search ..... 36/11.5, 36/101

See application file for complete search history.

(56) References Cited

U.S. PATENT DOCUMENTS 1,828,512 A * 10/1931 Serla ..... 36/58.5
1,855,345 A * 4/1932 Fischer, Jr. ..... 36/58.5
2,049,347 A * 7/1936 Benjamin ..... 36/58.5
2,111,378 A * 3/1938 Waxelbaum ..... 36/45

* cited by examiner

*Primary Examiner*—Ted Kavanaugh
(74) *Attorney, Agent, or Firm*—Kirschstein, et al.

(57) ABSTRACT

A shoe upper is reversible in its entirety to change the appearance of a shoe. The shoe upper is comprised of one or more straps each having end regions connected by swivel fasteners to the shoe.

12 Claims, 2 Drawing Sheets

REVERSIBLE SHOE UPPER

BACKGROUND OF THE INVENTION

1. Field of the Invention

The present invention generally relates to footwear, especially open shoes such as thongs, sandals and slip-ons, where the entire upper of the shoe is reversible in order to change the coloration, texture, aesthetics, indicia, styling, or other appearance of the shoe.

2. Description of the Related Art

A single pair of shoes is typically only harmonious with a single clothing ensemble. To provide versatility, the art has suggested reversing various shoe components to alter the appearance of the shoes. By way of example, U.S. Pat. No. 2,049,347 discloses a closed shoe having stationary upper portions of a certain color, and reversible straps which, when reversed, displayed different colors which contrasted with the color of the stationary upper portions. U.S. Pat. No. 4,805,321 discloses removable shoe tongues for changing the appearance of the tongues relative to the remainder of the shoes. U.S. Patent Publication No. 2005/0039345 also discloses a reversible shoe strap for changing the appearance of a shoe by detaching the strap prior to reversing its position on the shoe.

As advantageous as these known shoes are in changing the appearance of the shoe, experience has shown that they are not altogether satisfactory in practice. Only changing the appearance of single shoe component, for example, a tongue or a strap, does not change the appearance of the entire shoe. The styling and color of the other upper components of the shoe are not changed and, hence, limit the total visual impact of the change, as well as the versatility to achieve a totally different harmonious color scheme.

In addition, the known reversible shoe components have unsightly hardware to enable them to be reversed. Such hardware is not desirable on certain fashion shoes. Also, the hardware includes fasteners which are often difficult to manipulate, because the reversible shoe component typically must be at least partially detached from the shoe upper prior to reversal, and then re-attached to the shoe after the reversal. For some users, such manipulation is often excessive and, hence, not often attempted, thereby defeating the reversibility function.

SUMMARY OF THE INVENTION

Objects of the Invention

Accordingly, it is a general object of this invention to reverse the entire upper of the shoe for dramatically changing the entire appearance of the shoe.

More particularly, it is an object of the present invention to enable a wearer to more readily coordinate the wearer's clothing with the wearer's shoes.

Still another object of the present invention is to increase the versatility of footwear capable of having its entire appearance changed.

It is yet another object of the present invention to remove from the shoes unsightly hardware used for enabling reversibility, and to not require excessive manipulation of the hardware.

A still further object of the present invention is to enhance the styling of an open shoe.

FEATURES OF THE INVENTION

In keeping with the above objects and others which will become apparent hereinafter, one feature of the present invention resides, briefly stated, in a shoe comprising a sole and a reversible upper mounted in its entirety on the shoe for reversing movement between different exposed positions, each of which imparts a different appearance to the shoe. The shoe is open, for example, has no enclosure for the toes of the wearer's foot, and the upper is comprised of at least one elongated strap, and preferably a plurality of straps, each strap having end regions permanently connected to the shoe and having opposite contrasting surfaces. In one of the exposed positions, one contrasting surface of each strap is exposed to view, while, in the other exposed position, the other contrasting surface of each strap is exposed to view. The reversal of each strap is performed while the end regions of the respective strap remain connected to the shoe throughout the reversing movement.

In a preferred embodiment, a toe post is anchored in, and extends above, the sole. One end region of each strap is connected, preferably by a swivel fastener, to the sole, preferably at its periphery, and the other end region of each strap is connected, also preferably by a swivel fastener, to the toe post above the sole. Each swivel fastener includes a pair of fastener portions turnable relative to one another about an axis, and a spring for axially urging the fastener portions together to a locked condition. The width of each fastener portion is comparable to the width of each strap.

In accordance with this invention, the entire upper, that is, all the parts of the upper overlying a foot during wear are reversible to more completely and dramatically change the entire appearance of the shoe. The versatility of the footwear is increased. The wearer can more readily coordinate the wearer's clothing and shoes. The comparative width of the swivel fastener portions and their respective strap effectively conceals the swivel fastener in the sense that they are not large and unsightly and, hence, can be used even on high fashion shoes.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
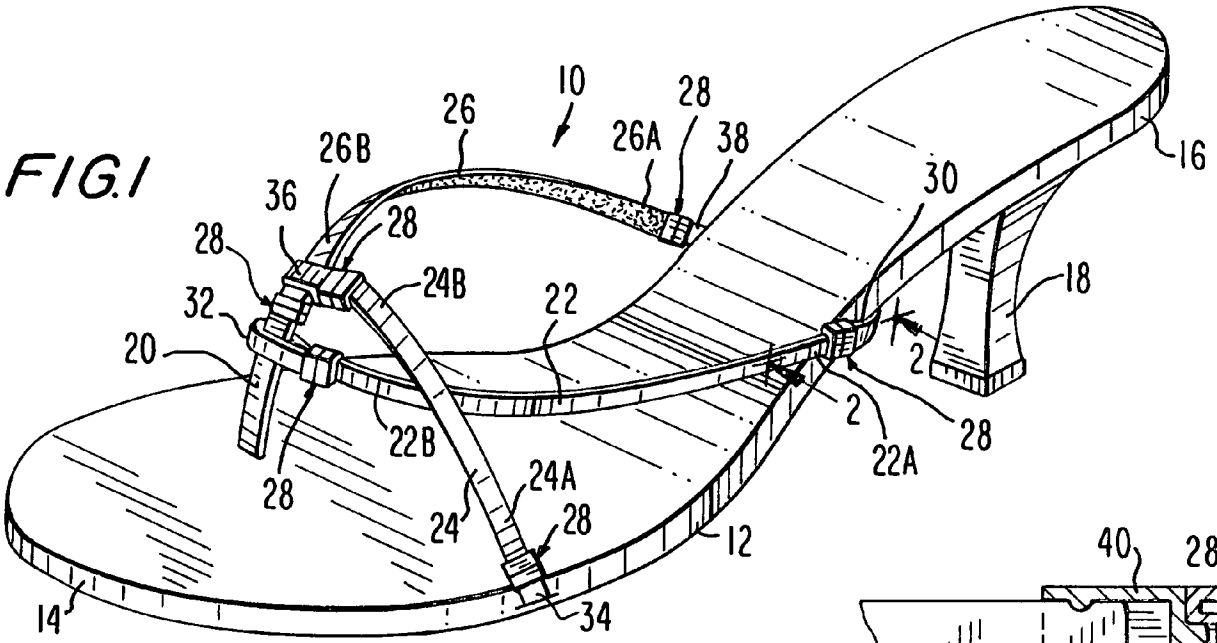
FIG. 1 is a perspective view of a shoe having a reversible upper with one exposed appearance in accordance with this invention.

FIG. 1 depicts a shoe 10, particularly an open shoe, such as a thong, sandal, slip-on and the like, having a sole 12 with a front part 14 for engaging the ground, and a rear part 16 elevated above the front part 14 by a heel 18. The sole 12 has a generally foot shape with a rounded front part and a rounded rear part. A left shoe 10 is depicted, and it will be understood that the invention described herein is also applicable to a right shoe to comprise a pair of footwear.

Figure 5:
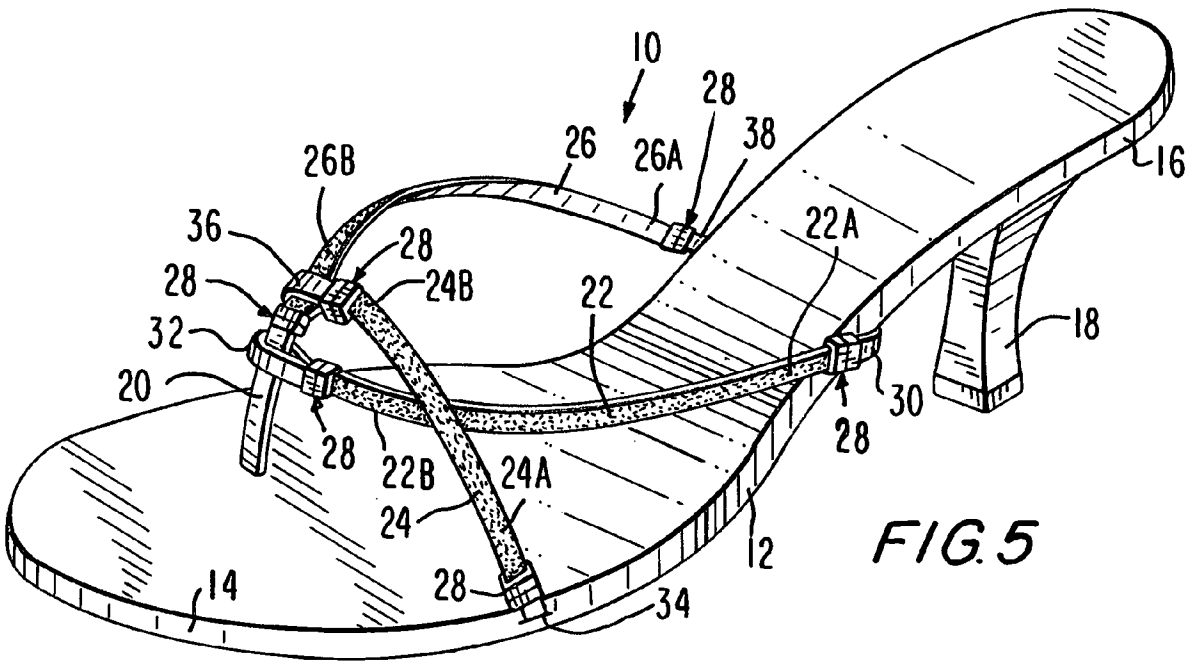
FIG. 5 is a view analogous to FIG. 1, but with a different outer exposed appearance.

A toe post 20 is anchored in, and extends above, the sole 12. During wear, the toe post is gripped between a wearer's first two toes. A reversible upper comprising, in FIG. 1, a plurality of straps 22, 24, 26, is mounted in its entirety on the shoe for reversing movement between a first exposed position depicted in FIG. 1, and a second exposed position depicted in FIG. 5. The straps 22, 24, 26 overlie the wearer's foot and, by reversing the positions of all the upper parts or straps of the upper, the entire appearance of the upper is changed.

Strap 22 is elongated and has an end region 22A which is connected by a swivel fastener 28 to one end of a sole strap 30 whose opposite end is anchored in the sole, and another end region 22B which is connected by another swivel fastener 28 to a looped toe strap 32 which is looped around the toe post 30. Strap 24 has an end region 24A which is connected by a swivel fastener 28 to one end of a sole strap 34 whose opposite end is anchored in the sole, and another end region 24B which is connected by another swivel fastener 28 to a looped strap 36 which is looped around the strap 26. Strap 26 has an end region 26A which is connected by a swivel fastener 28 to one end of a sole strap 38 whose opposite end is anchored in the sole, and another end region 26B which is connected by a swivel fastener 28 to the toe post 30.

Each strap 22, 24, 26 resembles a generally planar elongated belt of constant width. Each strap has opposite contrasting surfaces, as depicted by the non-stippled outer strap surfaces in FIG. 1, and the stippled outer strap surfaces in FIG. 5. The contrasting surfaces can be of different coloration, texture, aesthetics, indicia, styling, or any other appearance. The straps may be manufactured of natural or synthetic materials. As depicted, straps 22, 26 extend from opposite peripheral sides of the sole and meet at the toe post, while the strap 24 extends transversely of the sole.

Figure 2:
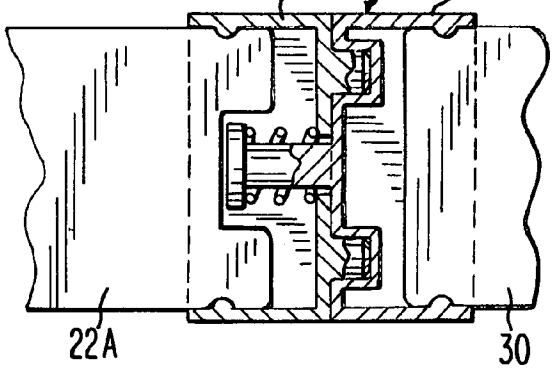
FIG. 2 is an enlarged sectional view in a locked condition of a fastener as taken on line 2-2 of FIG. 1.
Figure 3:
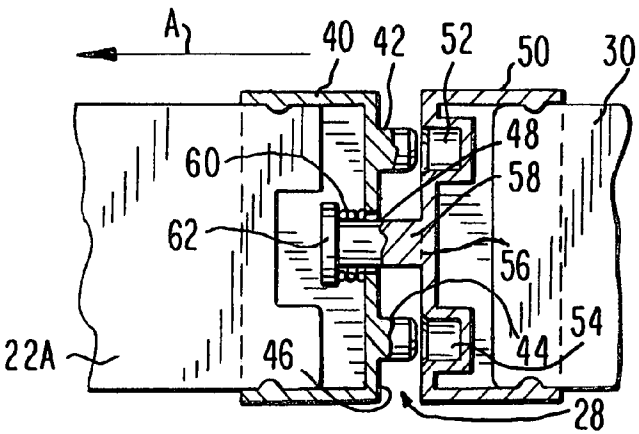
FIG. 3 is a view analogous to FIG. 2, but in an unlocked condition.
Figure 4:
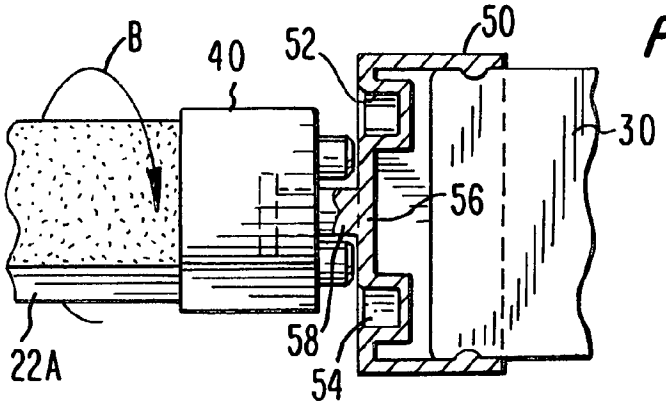
FIG. 4 is a view analogous to FIG. 3 during the reversing of a strap.

FIGS. 2-4 depict the structure and operation of each swivel fastener 28. Representative strap end 22A is snugly fitted into an open end of fastener portion 40 having a pair of projections 42, 44 extending from an end wall 46 which has a central hole 48. A mating fastener portion 50 snugly receives the strap 30 and has a pair of recesses 52, 54 formed in an end wall 56 from which a shaft 58 extends axially through the central hole 48. A spring 60 is captured between a headed end 62 of the shaft 58 and the end wall 46.

As seen in FIG. 2, the projections 42, 44 are received and held in the recesses 52, 54 by urging of the spring 60. This depicts the locked condition. To initiate the reversing of the strap 22, the fastener portion 40 is pulled axially along the direction of arrow A in FIG. 3 until the projections are completely removed from their recesses. The spring 60 is compressed during this axial motion. Next, as shown in FIG. 4, the fastener portion 40 is turned circumferentially along the direction of arrow B for a half turn. Upon releasing the fastener portion 40, the spring 60 releases its stored energy and urges the projections back into their recesses analogous to that shown in FIG. 2. When both swivel fasteners at opposite ends of a strap are so operated, the strap turns through 180°, thereby exposing its opposite surface to view.

The width of the swivel fasteners is comparable in size to the width of the strap. Also, the spring is concealed from view. The swivel fasteners are neither large, nor bulky, and appear to be mere decorative elements on the straps, thereby enhancing their use in high fashion shoes. It is also contemplated that the swivel fasteners be concealed within the straps, or within the sole.

By reversing all the upper parts that comprise the shoe upper, the entire appearance of the shoe is changed as desired by the wearer. The straps are not tensioned across the upper and side surfaces of the wearer's foot. It will be recalled that the springs within the swivel fasteners serve only to urge the fastener portions together and do not pull the strap to bite into the wearer's foot.

Fasteners, other than swivels, could also be used. Also, the number of straps could be more or less than that depicted. The width of the straps can likewise be changed from that shown in the drawings. The reversible uppers can be used for women's, men's or children's shoes. The straps could also go around the back of the foot.

It will be understood that each of the elements described above, or two or more together, also may find a useful application in other types of constructions differing from the types described above.

While the invention has been illustrated and described as embodied in a reversible shoe upper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A shoe, comprising:

a) a sole; and b) a reversible upper including an elongated strap having end regions permanently connected to the shoe and opposite contrasting surfaces between the end regions, an additional elongated strap having end regions permanently connected to the shoe and having opposite contrasting surfaces between the end regions of the additional elongated strap and an auxiliary elongated strap having end regions permanently connected to the shoe and having opposite contrasting surfaces between the end regions of the auxiliary elongated strap, the upper in its entirety being mounted on the shoe for reversing movement between different exposed positions in which the contrasting surfaces of each strap are respectively exposed to view while the end regions of each strap remain connected to the shoe during the reversing movement.

2. The shoe of claim 1, wherein each end region of each strap is connected to the shoe by a swivel fastener.

3. The shoe of claim 1, and a toe post anchored in, and extending above, the sole; and wherein one end region of each strap is connected to the sole, and an opposite end region of each strap is connected to the toe post.

4. The shoe of claim 3, wherein each end region of each strap is connected to the shoe by a swivel fastener.

5. The shoe of claim 1, wherein each strap is elongated longitudinally along a length and has a width transversely of its length, and wherein each swivel fastener includes a pair of fastener portions each having a width dimension about equal to the width of each strap.

6. The shoe of claim 1, and a heel for elevating a heel portion of the sole above a toe portion of the sole.

7. The shoe of claim 1, wherein the contrasting surfaces have different colors.

8. The shoe of claim 1, wherein the contrasting surfaces have different textures.

9. A shoe, comprising:

a) a sole;

b) a toe post anchored in, and extending above, the sole; and c) a reversible upper including an elongated strap having end regions permanently connected to the shoe and opposite contrasting surfaces between the end regions, the upper in its entirety being mounted on the shoe for reversing movement between different exposed positions in which the contrasting surfaces are respectively exposed to view while the end regions of the strap remain connected to the shoe during the reversing movement, one of the end regions of the strap being connected to the sole, and an opposite end region of the strap being connected to the toe post above the sole.

10. The shoe of claim 8, wherein each end region of the strap is connected to the shoe by a swivel fastener.

11. A shoe, comprising:

a) a sole; and b) a reversible upper including an elongated strap having end regions permanently connected to the shoe and opposite contrasting surfaces between the end regions, the upper in its entirety being mounted on the shoe for reversing movement between different exposed positions in which the contrasting surfaces are respectively exposed to view while the end regions of the strap remain connected to the shoe during the reversing movement, each end region of the strap being connected to the shoe by a swivel fastener, the swivel fastener including a pair of fastener portions turnable relative to one another about an axis, and a spring for axially urging the fastener portions together to a locked condition.

12. The shoe of claim 10, wherein one of the fastener portions includes a projection, and wherein the other of the projections includes a recess for receiving the projection in the locked condition.

* * * * *